US011690416B2

(12) United States Patent
Toratani

(10) Patent No.: US 11,690,416 B2
(45) Date of Patent: Jul. 4, 2023

(54) UPPER BODY OF GARMENT

(71) Applicant: Toratani Co., Ltd., Kahoku (JP)

(72) Inventor: Ikuo Toratani, Kahoku (JP)

(73) Assignee: TORATANI CO., LTD., Kahoku (JP)

( * ) Notice: Subject to any disclaimer, the term of this patent is extended or adjusted under 35 U.S.C. 154(b) by 198 days.

(21) Appl. No.: 16/765,218

(22) PCT Filed: Nov. 9, 2018

(86) PCT No.: PCT/JP2018/041662

§ 371 (c)(1),
(2) Date: May 19, 2020

(87) PCT Pub. No.: WO2019/102870

PCT Pub. Date: May 31, 2019

(65) Prior Publication Data

US 2021/0368897 A1 Dec. 2, 2021

(30) Foreign Application Priority Data

Nov. 21, 2017 (WO) ..... PCT/JP2017/041837

(51) Int. Cl.

| | |
|---|---|
| ***A41D 27/10*** | (2006.01) |
| ***A41B 9/06*** | (2006.01) |
| ***A41D 1/04*** | (2006.01) |

(52) U.S. Cl.

CPC ..... *A41D 27/10* (2013.01); *A41B 9/06* (2013.01); *A41D 1/04* (2013.01); *A41B 2400/38* (2013.01); *A41D 2400/38* (2013.01)

(58) Field of Classification Search

CPC ..... Y10S 2/04

(Continued)

(56) References Cited

U.S. PATENT DOCUMENTS 2,330,520 A * 9/1943 Saveth ..... A41D 27/10 2/93
2,941,210 A * 6/1960 Bren ..... A41D 27/10 2/125

(Continued)

FOREIGN PATENT DOCUMENTS

CN 1181692 A 5/1998
JP 2007-303024 11/2007

(Continued)

OTHER PUBLICATIONS

Chinese Office Action with English translation dated Aug. 4, 2021, 17 pages.

(Continued)

*Primary Examiner* — Heather Mangine
*Assistant Examiner* — Matthew R Marchewka
(74) *Attorney, Agent, or Firm* — Rankin, Hill & Clark LLP

(57) ABSTRACT

An upper body of a garment prevents a wearer from moving a shoulder forward to put an arm in front of the trunk. The upper body of the garment has a body with a left sleeve and a right sleeve. The body includes a rear body with a left armhole on the left side and a right armhole on the right side. A portion between the armholes exerts a tensile force to pull the shoulder blades of a wearer horizontally inward. The left sleeve includes a rear surface with a left sewn portion sewn to the left armhole. The left sewn portion is narrower in horizontal width than the deepest portion of the left armhole before a rear surface of an upper end of the left sleeve is sewed to the left armhole. The right sleeve is similar.

14 Claims, 14 Drawing Sheets

(58) Field of Classification Search
USPC ..... 2/78.3
See application file for complete search history.

(56) References Cited

U.S. PATENT DOCUMENTS

| | | | | |
|---|---|---|---|---|
| 2,986,740 | A * | 6/1961 | Schudson | A41D 27/10 2/93 |
| 3,187,334 | A * | 6/1965 | Porcello | G07C 1/10 346/17 |
| 3,187,344 | A * | 6/1965 | Porcello | A41D 3/00 2/84 |
| 5,282,277 | A * | 2/1994 | Onozawa | A41D 13/00 2/46 |
| 5,937,442 | A | 8/1999 | Yamaguchi et al. | |
| 6,895,597 | B1 * | 5/2005 | Rakic | A41D 27/10 2/243.1 |
| 2004/0016041 | A1 * | 1/2004 | Uno | A41B 9/06 2/113 |
| 2007/0028351 | A1 * | 2/2007 | Coolik | A41D 27/10 2/115 |
| 2007/0271671 | A1 * | 11/2007 | Okajima | A41D 1/04 2/69 |
| 2008/0141431 | A1 * | 6/2008 | Rance | A41D 7/00 2/243.1 |
| 2009/0077708 | A1 * | 3/2009 | Takamato | A41D 13/0015 2/69 |
| 2011/0035859 | A1 * | 2/2011 | Koga | A41D 13/0015 2/69 |
| 2014/0090146 | A1 * | 4/2014 | Yeomans | A61B 5/6805 2/69 |

FOREIGN PATENT DOCUMENTS

| | | |
|---|---|---|
| JP | 2011-072323 | 4/2011 |
| JP | 2013-119677 | 6/2013 |
| JP | 2013-151771 | 8/2013 |
| JP | 2014-196587 | 10/2014 |
| WO | 2010/100721 A1 | 9/2010 |
| WO | 2017/098821 | 6/2017 |

OTHER PUBLICATIONS

International Search Report, dated Feb. 12, 2019, dated Feb. 12, 2019, 2 pages.

* cited by examiner

UPPER BODY OF GARMENT

TECHNICAL FIELD

The invention relates to upper body garments.

BACKGROUND ART

An upper body of a garment is known, which can cover at least a portion of the upper body of a wearer. See Patent Literature 1, for example.

CITATION LIST

Patent Literature

Patent Literature 1: JP 2014-196587 A

SUMMARY OF INVENTION

When using a mobile device such as a smartphone, a person tends to move his/her shoulder forward from a position in a predefined posture to put the arm operating the mobile device in front of the trunk. The "predefined posture" means a good posture generally known, in which a person standing on a flat surface puts the root of the neck, the shoulders, the elbows, and the ankles in a substantially straight line when viewed end-on. The posture in which the shoulders are placed in front of the position in the predefined posture is called as "rounded shoulders" or "curved back." When a person maintains this posture frequently or continuously for a long time, he/she can suffer stiff shoulders, bad postures, or the like.

In view of the above-mentioned problems, the invention is devised. An object of the invention is to provide the upper body of a garment preventing a wearer from moving a shoulder forward to put an arm in front of the trunk.

In an upper body of a garment according to one aspect of the invention, a body is connected with a left sleeve and a right sleeve. The body includes a rear body with a left armhole on the left side and a right armhole on the right side. The portion of the rear body between the left armhole and the right armhole exerts a tensile force to pull the shoulder blades of a wearer horizontally inward. The left sleeve includes a rear surface with a left sewn portion sewn to the left armhole. The right sleeve includes a rear surface with a right sewn portion sewn to the right armhole. The left sewn portion is narrower in horizontal width than the deepest portion of the left armhole before a rear surface of an upper end of the left sleeve is sewed to the left armhole. The right sewn portion is narrower in horizontal width than the deepest portion of the right armhole before a rear surface of an upper end of the right sleeve is sewed to the right armhole. The above-described structure provides this garment with a three-dimensional form in which both the sleeves extend backward from the standard directions. Accordingly, even a person with a standard figure only has to put his/her arms through the sleeves to let his/her shoulders be pulled backward by a high tensile force between the left and right armholes of the rear body. That is, the high tensile force between the left and right armholes of the rear body pulls the shoulder blades of a wearer horizontally inward and puts a heavy load on the upper portions of the upper arms and the shoulders of the wearer to move them backward. As a result, the garment prevents the wearer from moving the shoulders forward to put the upper portions of the upper arms in front of his/her trunk. This enables the wearer to reliably avoid bad postures such as rounded shoulders and curved back and can achieve good corrective effects for persons who have already suffered rounded shoulders or curved back.

The range in which the left sewn portion is narrower in horizontal width than the deepest portion of the left armhole may have an upper boundary at 10 cm below the upper end of the left armhole. The range in which the right sewn portion is narrower in horizontal width than the deepest portion of the right armhole may have an upper boundary at 10 cm below the upper end of the right armhole. The range of the left sewn portion may have a lower boundary at 2 cm-5 cm or 2 cm-10 cm below the deepest portion of the left armhole. The range of the right sewn portion may have a lower boundary at 2 cm-5 cm or 2 cm-10 cm below the deepest portion of the right armhole. The high tensile force between the left and right armholes of the rear body does not have to be always present in a region from the upper end of each armhole to the lower end thereof. When the deepest portion is located at an intermediate portion of each armhole, the high tensile force is preferably present in a portion of the armhole ranging from more than 3 cm above the deepest portion to more than 3 cm below the deepest portion. When the deepest portion is located at the upper end of each armhole, the high tensile force is preferably present in a portion of the armhole ranging from the upper end to more than 6 cm below the deepest portion. When the deepest portion is located at the lower end of each armhole, the high tensile force is preferably present in a portion of the armhole ranging from more than 6 cm above the deepest portion to the lower end. The high tensile force only has to be present in an appropriate range.

At least the rear surface of the left sleeve may include a high-tension region that exerts a stretching force of 45 centinewtons (cN) or more when being stretched by 20% in a longitudinal direction of the left sleeve. At least the rear surface of the right sleeve may include a high-tension region that exerts a stretching force of 45 cN or more when being stretched by 20% in a longitudinal direction of the right sleeve. The high-tension region of the left sleeve may range from the rear surface of the left sleeve to a front surface thereof. The high-tension region of the right sleeve may range from the rear surface of the right sleeve to a front surface thereof. The front surface of the left sleeve may include a non-stretchy region that is stretched by less than 20% when receiving a stretching force of 45 cN or more in a longitudinal direction of the left sleeve. The front surface of the right sleeve may include a non-stretchy region that is stretched by less than 20% when receiving a stretching force of 45 cN or more in a longitudinal direction of the right sleeve. The inventor has newly found that the above-described structure can prevent the stretched rear surfaces of the sleeves from greatly reducing the tensile force the rear body applies to the wearer so that the structure can exert a stronger force to move the shoulder blades, the upper portions of the upper arms, and the shoulders of the wearer backward, and further, toward the center of his/her back.

At least a rear surface of the left sleeve may include a non-stretchy region that is stretched by less than 20% when receiving a stretching force of 45 cN or more in a longitudinal direction of the left sleeve. At least a rear surface of the right sleeve may include a non-stretchy region that is stretched by less than 20% when receiving a stretching force of 45 cN or more in a longitudinal direction of the right sleeve. The non-stretchy region of the left sleeve may range from the rear surface of the left sleeve to a front surface thereof. The non-stretchy region of the right sleeve may range from the rear surface of the right sleeve to a front surface thereof. The front surface of the left sleeve may include a high-tension region that exerts a stretching force of 45 cN or more when being stretched by 20% in a longitudinal direction of the left sleeve. The front surface of the right sleeve may include a high-tension region that exerts a stretching force of 45 cN or more when being stretched by 20% in a longitudinal direction of the right sleeve. Any of the above-described structures can more strongly pull the shoulder blades, the upper portions of the upper arms, and the shoulders of the wearer toward the rear body and move them backward and toward the center of the back of the wearer. This can enhance the corrective effects for the posture of the wearer.

A horizontal distance from a left side of the body to the deepest portion of the left armhole may equal a horizontal distance from a right side of the body to the deepest portion of the right armhole. A half to six times as long as the horizontal distance may equal a horizontal distance from the deepest portion of the left armhole to the deepest portion of the right armhole. This structure can prevent a portion of the upper body of the garment covering a shoulder of the wearer from moving to the back of the wearer, and accordingly, it enables the upper body of the garment to avoid wrinkles and obstructing movement of the wearer.

At least a portion of the left sleeve facing the left armpit of a wearer and a portion of the right sleeve facing the right armpit of the wearer may have highly flexible fabrics. This structure can prevent the wearer from feeling a pain on his/her armpits even if the tensile force of the rear body moves the rear surfaces of joints of the sleeves backward and toward the center of the back of the wearer.

Since the rear body is formed to be narrower in horizontal width than the front body due to the presence of the left and right armholes, the rear body can exert a tensile force to pull the wearer horizontally inward even when the front and rear bodies are made of the same fabric. The rear body may be made of the same fabric as the front body, and the fabric may have woofs directed vertically in the front body and horizontally in the rear body. The rear body may include a portion made of the same fabric as the front body to which resin is applied such that the portion exerts a horizontal tensile force greater than the front body. The rear body may be made of fabric that exerts a tensile force greater than the front body. The rear body may be made of laminated fabrics such that the rear body exerts a tensile force greater than the front body. Any of these structures can easily exert a tensile force of a required strength on the rear body.

The invention can provide the upper body of the garment preventing a wearer from moving a shoulder forward to put an arm in front of the trunk.

DESCRIPTION OF EMBODIMENTS

Embodiments of the invention will be explained with reference to the drawings.

First Embodiment

Figure 1:
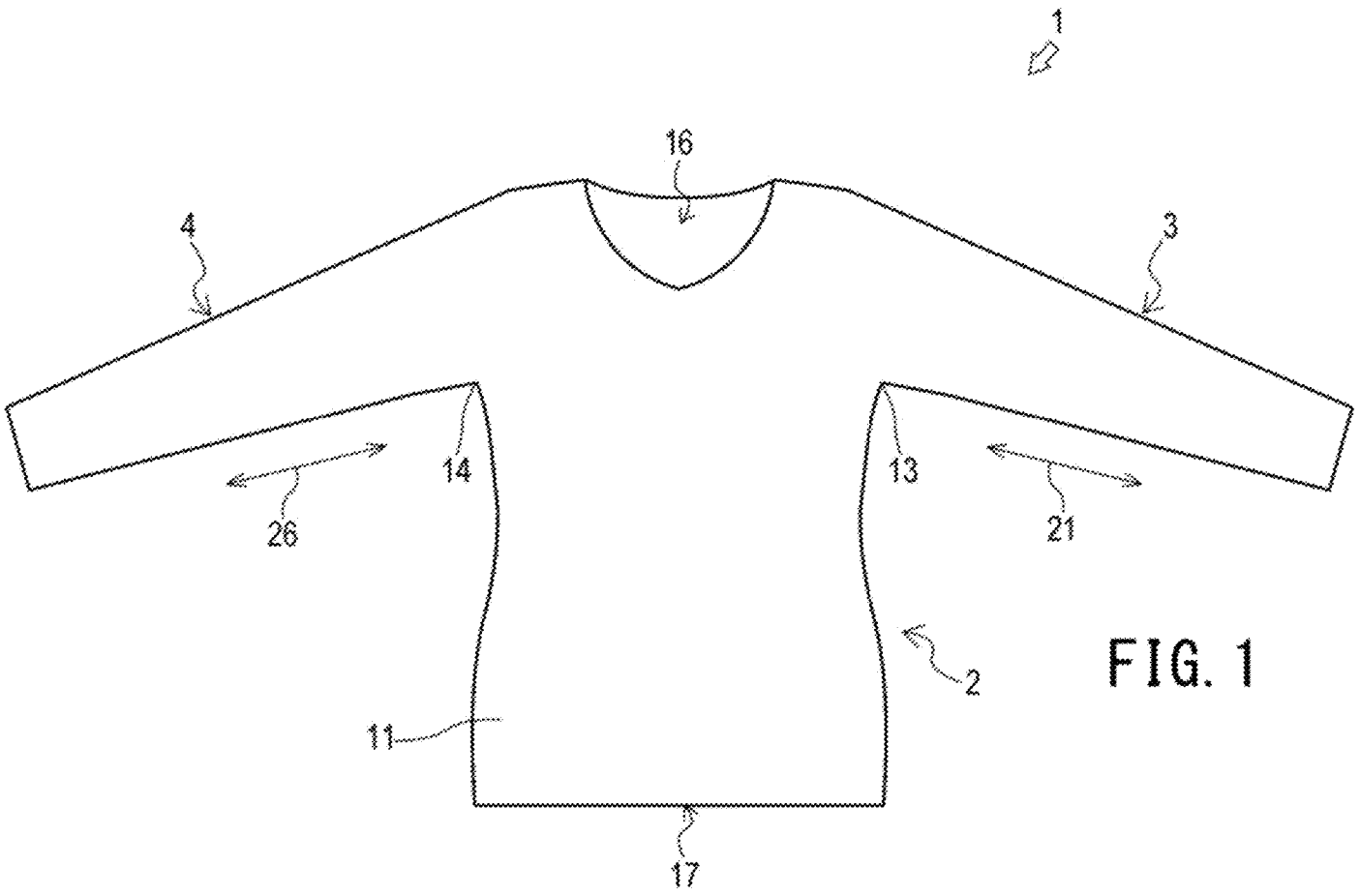
FIG. 1 is a front elevation view of the upper body of a garment according to a first embodiment of the invention.
Figure 2:
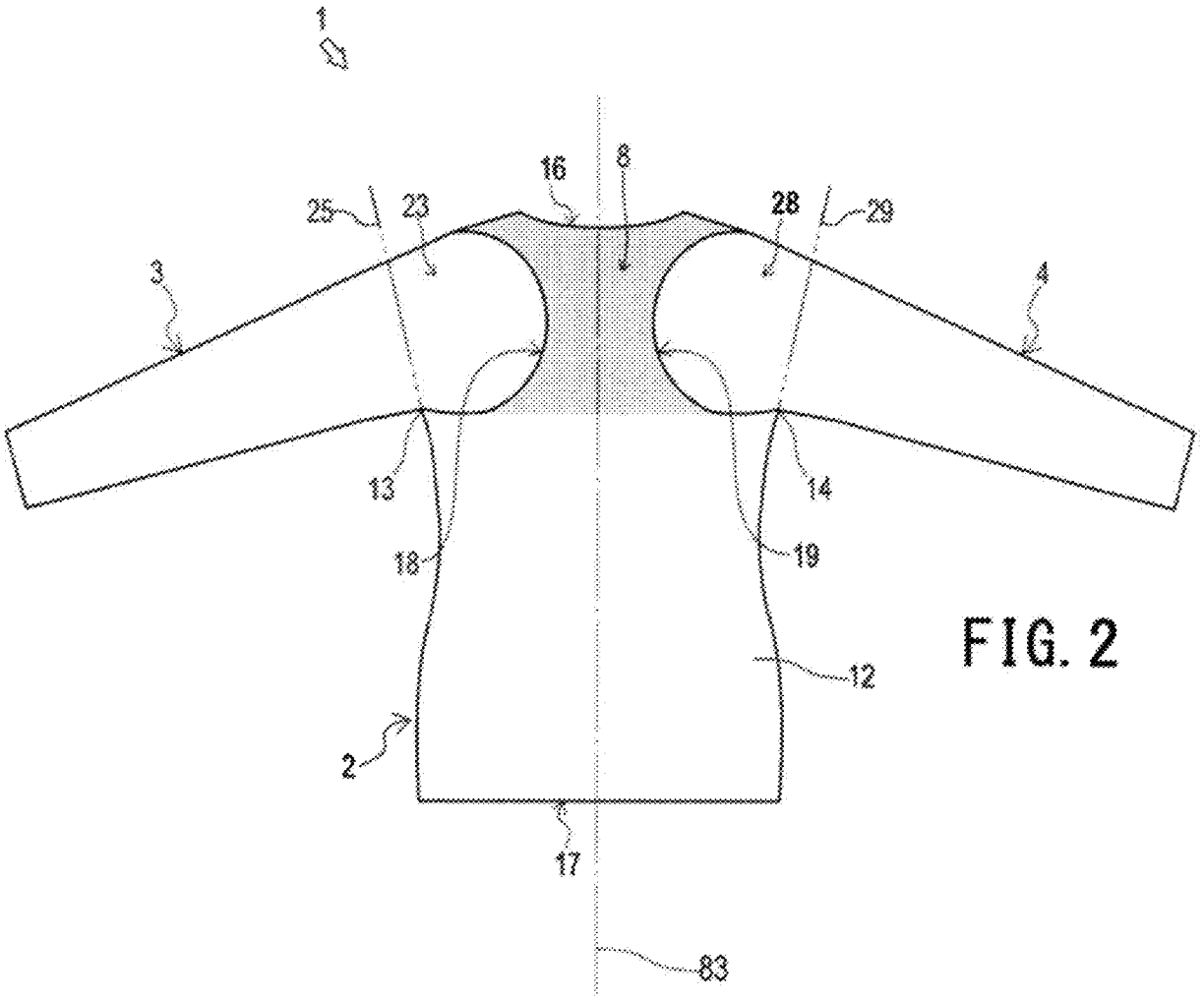
FIG. 2 is a rear elevation view of the upper body of the garment of FIG. 1.

FIG. 1 shows a front elevation view of the upper body 1 of a garment according to a first embodiment of the invention. FIG. 2 shows a rear elevation view of the upper body 1. In FIGS. 1 and 2, the upper body 1 is spread flat. As shown in FIGS. 1 and 2, the upper body 1 is made to fit the upper body of a wearer. The upper body 1 of the garment may be used as an under garment, or as an intermediate or outer garment, which is worn over an under garment.

The upper body 1 of the garment includes a body 2, a left sleeve 3, and a right sleeve 4. The body 2 includes a front body 11 and a rear body 12. The rear body 12 has a rear region 8. The left sleeve 3 is sewn to the left side of the rear region 8. The right sleeve 4 is sewn to the right side of the rear region 8.

The body 2 has a cylindrical shape whose axial direction is a vertical direction of the upper body 1 of the garment. The body 2 is made to be stretched at least in the rear region 8 to fit and cover the upper body of a wearer. Although, in the body 2 according to the first embodiment, the front body 11 and the rear body 12 are separable from each other, they may be integrated with each other.

The front body 11 is a portion of the body 2 facing the front surface of the upper body of a wearer and covering almost all the front surface of the upper body of the wearer. The rear body 12 is a portion of the body 2 facing the rear surface of the upper body of the wearer and covers almost all the rear surface of the upper body of the wearer.

The rear region 8 of the rear body 12 (see a first dotted area in FIG. 2) is a region between a concave area sewn to the left sleeve 3 and a concave area sewn to the right sleeve 4 and exerts a tensile force to pull a wearer horizontally inward. The rear region 8 is located above a horizontal line connecting the left side 13 of the body 2 with the right side 14 thereof by the shortest distance. Even when made of the same fabric as the front body 11, the rear region 8 is narrower in horizontal width than the front body 11. This causes a tensile force in the rear region 8 to pull the wearer horizontally inward. Alternatively, it is possible to cause at least the rear region 8 to exert a tensile force greater than the front body 11 by changing the fabric into one capable of exerting a greater tensile force or by using two or more fabrics laminated one on top of the other. It is also possible to cause the rear body 12, particularly the rear region 8, to exert a tensile force greater than the front body 11 by making it of the same fabric as the front body 11 and directing woofs of the fabric vertically in the front body 11 and horizontally in the rear body 12. The rear region 8 may include a portion made of the same fabric as the front body 11 to which a resin is applied. The resin is a type of a particularly high elasticity such as polyurethane, silicone resin, and polyvinyl chloride. In this case, the rear region 8 can exert a tensile force greater than the front body 11.

The rear region 8 exerts a tensile force on the wearer of the upper body 1 of the garment, thereby pulling its portion sewn to the left sleeve 3 rightward and its portion sewn to the right sleeve 4 leftward. At least the rear region 8 of the rear body 12 has a stretching force of 60 cN or more when being horizontally stretched by 20%. This stretching force preferably ranges from 80 cN to 600 cN, more preferably, from 100 cN to 400 cN when the rear region 8 is horizontally stretched by 20%.

The body 2 includes a neckline 16, a hem 17, a left edge 18 to be attached, and a right edge 19 to be attached. The neckline 16 is disposed at the upper end of the body 2 and the horizontal center thereof. The hem 17 is disposed below the neckline 16. The left edge 18 is a portion of the body 2 to be used to sew the rear surface of the left sleeve 3 to the rear region 8, i.e. the rear body 12 of the body 2, and is disposed on the left side of the rear region 8. The right edge 19 is a portion of the body 2 to be used to sew the rear surface of the right sleeve 4 to the rear region 8 (i.e. the rear body 12 (of the body 2)) and is disposed on the right side of the rear region 8.

The left sleeve 3 is a cylindrical body extending in a longitudinal direction of the left sleeve 3, i.e. an axial direction thereof, which is generally the direction of an arrow 21 in FIG. 1. The inside of the left sleeve 3 is connected with the inside of the body 2. In the first embodiment, the left sleeve 3 is a long sleeve. Instead, a left sleeve according to the invention may be a short or three-quarter sleeve.

One longitudinal end of the left sleeve 3, i.e. its upper end near the body 2, has a rear surface 23. See a second dotted area in FIG. 2. As shown in FIG. 2, the rear surface 23 of the upper end means a portion of the left sleeve 3 located nearer to the rear region 8 than a left-side reference line (or a first virtual line) 25, which extends from the left side 13 of the upper body 1 of the garment to a direction perpendicular to the longitudinal direction of the left sleeve 3. The rear surface 23 of the upper end abuts the rear region 8 of the rear body 12 of the body 2.

The rear surface 23 of the upper end of the left sleeve 3 is sewn to the left side of the rear region 8, i.e. the left edge 18 thereof. At least the rear surface 23 of the left sleeve 3 has a stretching force ranging from 45 cN to 600 cN when being stretched by 20% in the longitudinal direction of the left sleeve 3. This stretching force preferably ranges from 60 cN to 500 cN, more preferably, from 80 cN to 400 cN when the rear surface 23 is stretched by 20% in the longitudinal direction of the left sleeve 3.

The right sleeve 4 is a cylindrical body extending in a longitudinal direction of the right sleeve 4, i.e. an axial direction thereof, which is generally the direction of an arrow 26 in FIG. 1. The inside of the right sleeve 4 is connected with the inside of the body 2. In the first embodiment, the right sleeve 4 is a long sleeve. Instead, a right sleeve according to the invention may be a short or three-quarter sleeve.

One longitudinal end of the right sleeve 4, i.e. its upper end near the body 2, has a rear surface 28. See the second dotted area in FIG. 2. As shown in FIG. 2, the rear surface 28 of the upper end means a portion of the right sleeve 4 located nearer to the rear region 8 than a right-side reference line (or a second virtual line) 29, which extends from the right side 14 of the upper body 1 of the garment to a direction perpendicular to the longitudinal direction of the right sleeve 4. The rear surface 28 of the upper end abuts the rear region 8 of the rear body 12 of the body 2.

The rear surface 28 of the upper end of the right sleeve 4 is sewn to the right side of the rear region 8, i.e. the right edge 19 thereof. At least the rear surface 28 of the right sleeve 4 has a stretching force ranging from 45 cN to 600 cN when being stretched by 20% in the longitudinal direction of the right sleeve 4. This stretching force preferably ranges from 60 cN to 500 cN, more preferably, from 80 cN to 400 cN when the rear surface 28 is stretched by 20% in the longitudinal direction of the right sleeve 4.

The above-mentioned stretching force is measured as follows. A textile, which is 10 cm long and 2.5 cm wide, is cut out of each fabric used in the manufacture of the body 2, the left sleeve 3, and the right sleeve 4. The textile is stretched by a constant-rate-loading tensile machine, an AGS-X made by Shimadzu corporation, in a predetermined direction at a rate of 30 cm/min. A stretching force of the textile stretched by 20% is measured at about 20 degrees Celsius, i.e., 18-22 degrees Celsius.

As described above, the rear surface 23 of the upper end of the left sleeve 3 and the rear surface 28 of the upper end of the right sleeve 4 are formed as high-tension regions, which exert a stretching force of 45 cN or more when being longitudinally stretched by 20%. The inventor has newly found that this structure prevents the stretched rear surface 23 of the upper end of the left sleeve 3 and the stretched rear surface 28 of the upper end of the right sleeve 4 from greatly reducing a tensile force that the rear region 8 of the body 2 exerts to pull a wearer of the upper body 1 of the garment, i.e. to pull the rear surface 23 of the upper end of the left sleeve 3 rightward and to pull the rear surface 28 of the upper end of the right sleeve 4 leftward. The inventor has also found that a force to move the upper portions of the upper arms and the shoulders of the wearer backward and toward the center of the back of the wearer is more greatly enhanced.

Figure 3:
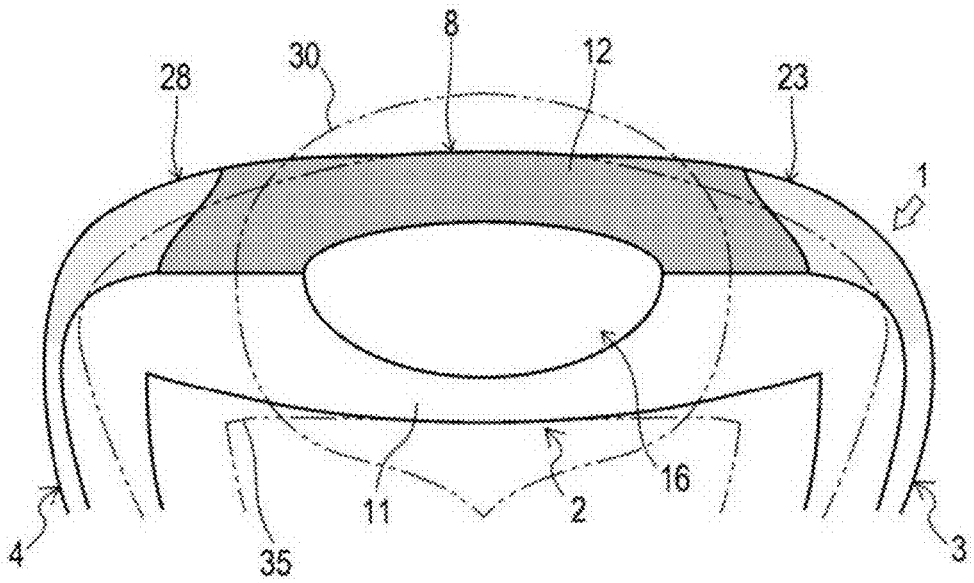
FIG. 3 is a schematic plan view showing the upper body of the garment of FIG. 1 worn by a person.

This force can put a heavy load on the upper portions of the upper arms and the shoulders of the wearer to move them backward. The load prevents the wearer 30 from having the bad posture 35 shown in FIG. 3, i.e. moving the shoulders forward to put the upper portions of the upper arms in front of the trunk. As a result, the upper body 1 of the garment can effectively prevent the wearer from suffering rounded shoulders and curved back. The upper body 1 of the garment can also achieve good corrective effects for persons who have already suffered rounded shoulders and curved back.

Figure 4:
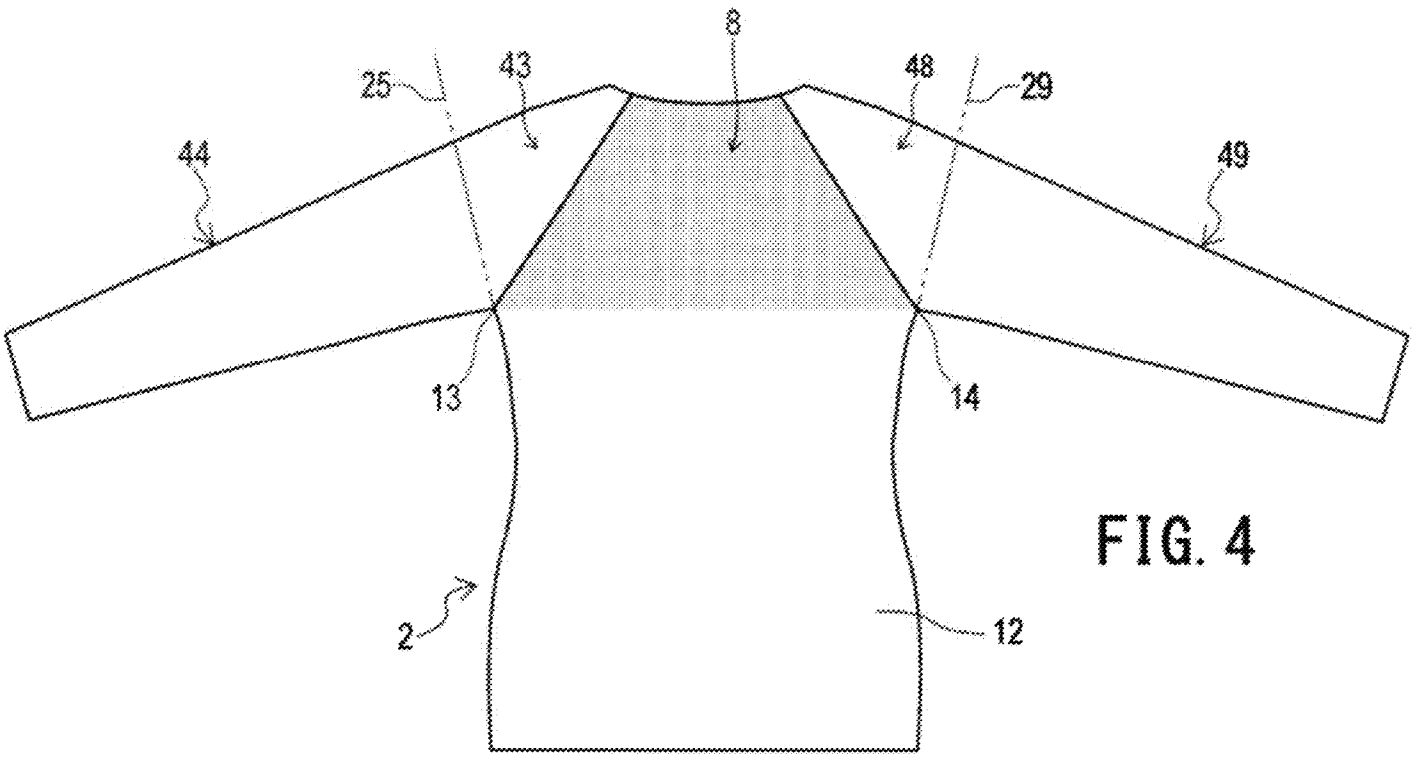
FIG. 4 is a rear elevation view of the upper body of a garment according to another embodiment of the invention.

The rear surface 23 of the upper end of the left sleeve 3 and the rear surface 28 of the upper end of the right sleeve 4 according to the first embodiment are sewn to either sides of the rear region 8 of the body 2 at a relatively long distance from the neckline 16. But, left and right sleeves of the invention are not limited to that. For example, they may be a left sleeve 44 and a right sleeve 49 in FIG. 4, whose rear surfaces 43 and 48 of the upper ends are sewn to either sides of the rear region 8 of the body 2 at a relatively short distance from the neckline 16.

Second Embodiment

Figure 5:
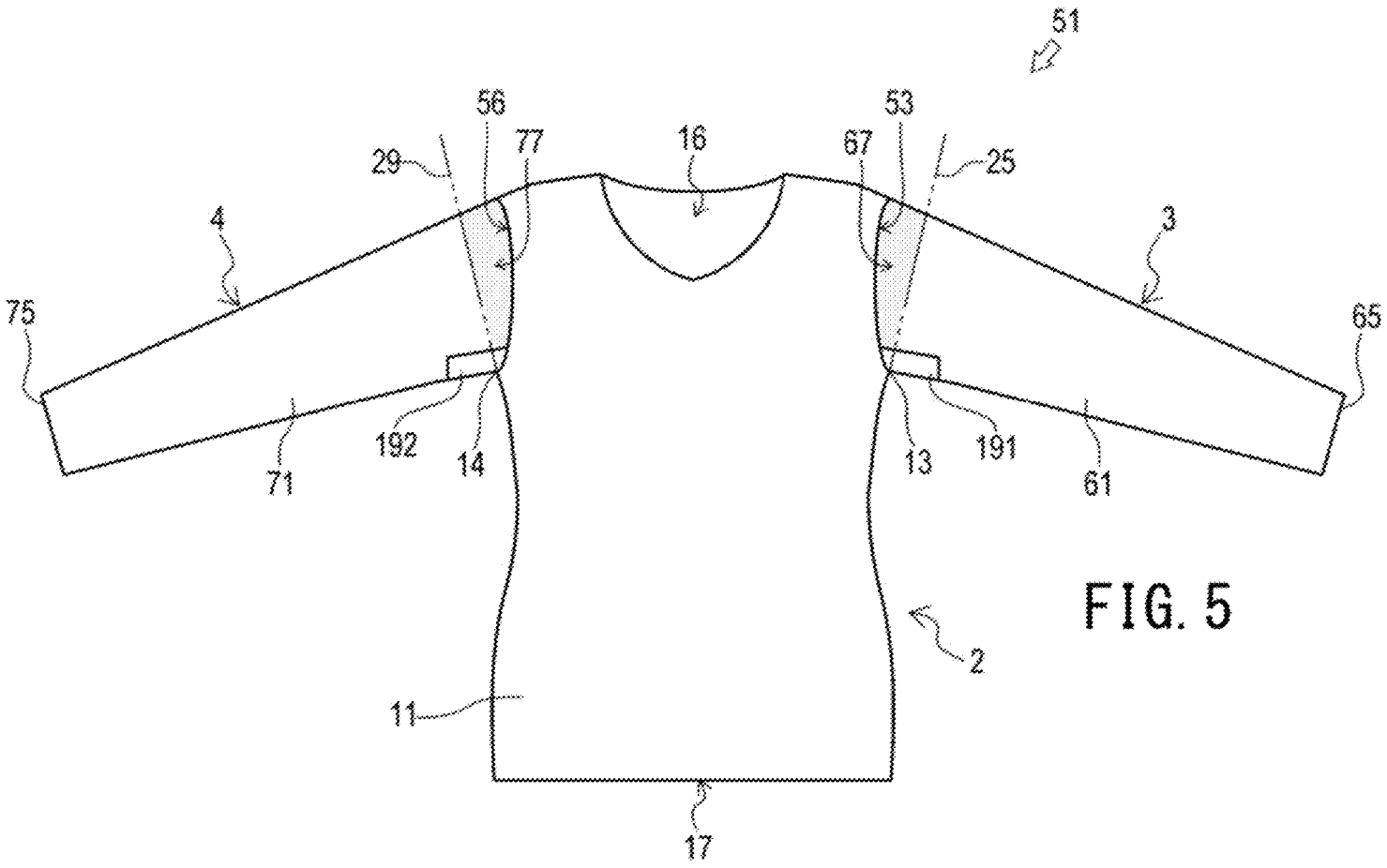
FIG. 5 is a front elevation view of the upper body of a garment according to a second embodiment of the invention.
Figure 6:
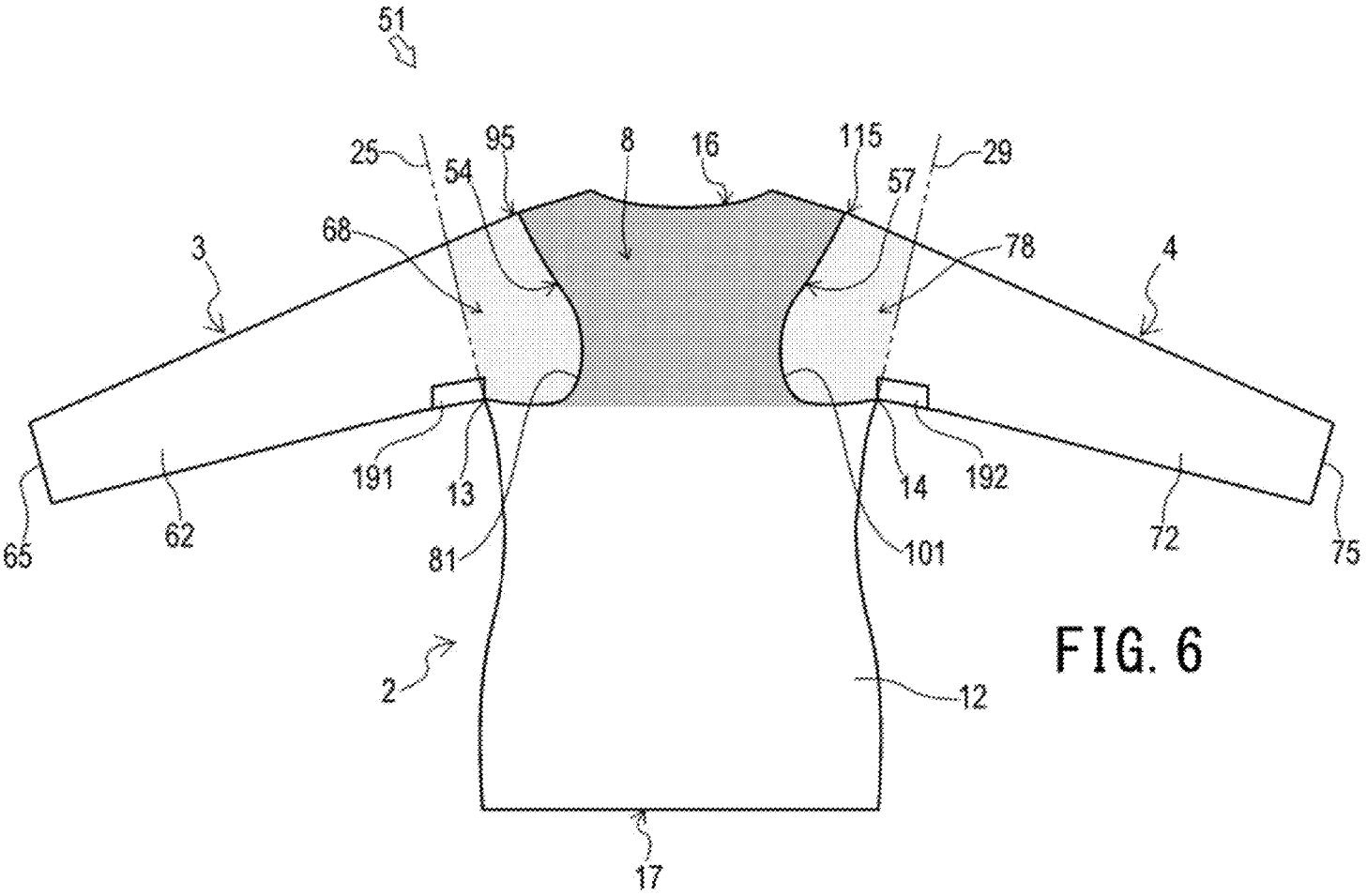
FIG. 6 is a rear elevation view of the upper body of the garment of FIG. 5.
Figure 7:
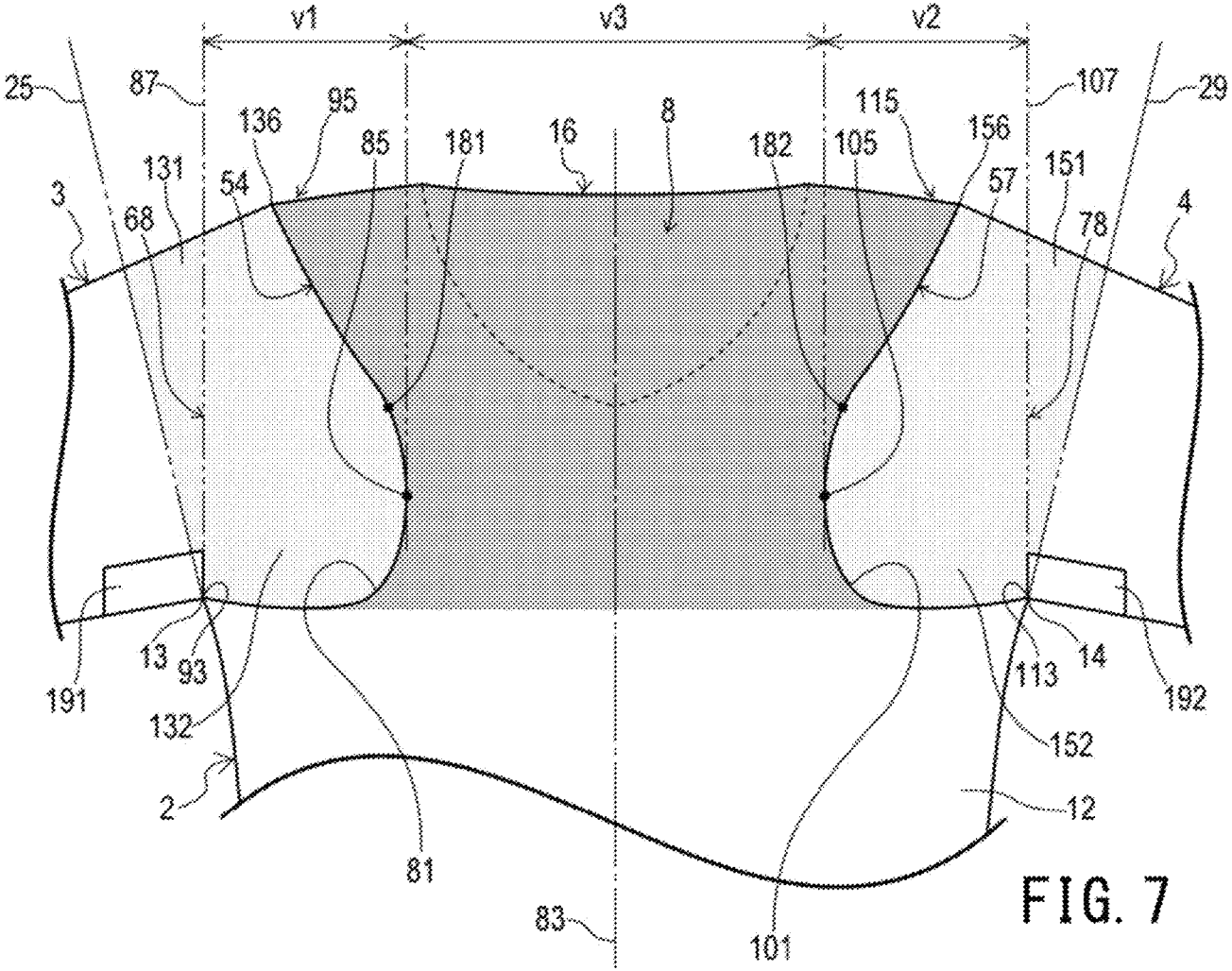
FIG. 7 is a partially exploded view of FIG. 6.

FIG. 5 shows a front elevation view of the upper body 51 of a garment according to a second embodiment of the invention. FIG. 6 shows a rear elevation view of this upper body 51. FIG. 7 shows a partially exploded view of FIG. 6. In FIGS. 5 and 6, the upper body 51 is spread flat. The upper body 51 according to the second embodiment differs from the upper body 1 according to the first embodiment in structure of sewn portions between the rear region 8 of the body 2 and the sleeves 3 and 4. That is, as shown in FIGS. 5, 6, and 7, the body 2 of the upper body 51 has a left armhole and a right armhole. At the left armhole, the left sleeve 3 is attached to the body 2. At the right armhole, the right sleeve 4 is attached to the body 2.

The left armhole of the body 2 forms a left edge to be attached and has a front surface 53 and a rear surface 54. Hereinafter, the front surface 53 is referred to as a left-edge front surface 53 and the rear surface 54 is referred to as a left-edge rear surface 54. The left-edge front surface 53 is disposed in front of the left armhole of the body 2. The left-edge front surface 53 is located at the upper left of the front body 11. The left-edge rear surface 54 is disposed behind the left armhole of the body 2. The left-edge rear surface 54 is located at the upper left of the rear body 12, i.e. the left side of the rear region 8.

The right armhole of the body 2 forms a right edge to be attached and has a front surface 56 and a rear surface 57. Hereinafter, the front surface 56 is referred to as a right-edge front surface 56 and the rear surface 57 is referred to as a right-edge rear surface 57. The right-edge front surface 56 is disposed in front of the right armhole of the body 2. The right-edge front surface 56 is located at the upper right of the front body 11. The right-edge rear surface 57 is disposed behind the right armhole of the body 2. The right-edge rear surface 57 is located at the upper right of the rear body 12, i.e. the right side of the rear region 8.

In the second embodiment, the rear region 8 extends from the left-edge rear surface 54 to the right-edge rear surface 57. In other words, the rear region 8 extends from the left edge of the rear region 8 sewn to the left sleeve 3 to the right edge of the rear region 8 sewn to the right sleeve 4.

The left sleeve 3 has a front surface 61 and a rear surface 62. Although these surfaces according to the second embodiment are separable from each other, these surfaces may be integrated with each other. The front surface 61 and the rear surface 62 of the left sleeve 3 are continuously aligned back and forth so that the left sleeve 3 forms a cylindrical shape. The front surface 61 and the rear surface 62 of the left sleeve 3 are sewn to the left armhole of the body 2 at the one longitudinal end of the left sleeve 3, i.e. the upper end thereof, and form a lower edge 65 of the left sleeve 3 at another longitudinal end (a lower end) of the left sleeve 3.

The front surface 61 of the left sleeve 3 includes a front surface 67 of the upper end of the left sleeve 3. The front surface 67 of the upper end means, as shown in FIG. 5, a portion of the left sleeve 3 ranging from the left side 13 of the upper body 1 of the garment to the left-side reference line (i.e. the first virtual line) 25 perpendicular to the longitudinal direction of the left sleeve 3, i.e. a portion of the left sleeve 3 nearer to the rear region 8 than the left-side reference line 25. The front surface 67 of the upper end of the left sleeve 3 is disposed in front of the one longitudinal end (i.e. the upper end) of the left sleeve 3 and is adjacent to the left-edge front surface 53 of the body 2, i.e. the upper left of the front body 11.

The rear surface 62 of the left sleeve 3 includes a rear surface 68 of an upper end of the left sleeve 3. The rear surface 68 of the upper end of the left sleeve 3 is disposed behind the one longitudinal end (the upper end) of the left sleeve 3 and is adjacent to the left-edge rear surface 54 of the body 2, i.e. the upper left of the rear body 12.

The left sleeve 3 is sewn to the left-edge rear surface 54, i.e. the left side of the rear region 8. At least the rear surface 68 of the upper end of the left sleeve 3 can exert a stretching force ranging from 45 cN to 600 cN when being stretched by 20% in the longitudinal direction of the left sleeve 3. The stretching force preferably ranges from 60 cN to 500 cN, more preferably, from 80 cN to 400 cN when the left sleeve 3 is longitudinally stretched by 20%.

The right sleeve 4 has a front surface 71 and a rear surface 72. Although these surfaces according to the second embodiment are separable from each other, these surfaces may be integrated with each other. The front surface 71 and the rear surface 72 of the right sleeve 4 are continuously aligned back and forth so that the right sleeve 4 forms a cylindrical shape. The front surface 71 and the rear surface 72 of the right sleeve 4 are sewn to the right armhole of the body 2 at the one longitudinal end (i.e. the upper end) of the right sleeve 4 and form a lower edge 75 of the right sleeve 4 at another longitudinal end (a lower end) of the right sleeve 4.

The front surface 71 of the right sleeve 4 includes a front surface 77 of the upper end of the right sleeve 4. The front surface 77 of the upper end means, as shown in FIG. 5, a portion of the right sleeve 4 ranging from the right side 14 of the upper body 1 of the garment to the right-side reference line (i.e. the second virtual line) 29 perpendicular to the longitudinal direction of the right sleeve 4, i.e. a portion of the right sleeve 4 nearer to the rear region 8 than the right-side reference line 29. The front surface 77 of the upper end of the right sleeve 4 is disposed in front of the one longitudinal end (the upper end) of the right sleeve 4 and is adjacent to the right-edge front surface 56 of the body 2, i.e. the upper right of the front body 11.

The rear surface 72 of the right sleeve 4 includes a rear surface 78 of the upper end of the right sleeve 4. The rear surface 78 of the upper end of the right sleeve 4 is disposed behind the one longitudinal end (the upper end) of the right sleeve 4 and is adjacent to the right-edge rear surface 57 of the body 2, i.e. the upper right of the rear body 12.

The right sleeve 4 is sewn to the right-edge rear surface 57, i.e. the right side of the rear region 8. At least the rear surface 78 of the upper end of the right sleeve 4 can exert a stretching force ranging from 45 cN to 600 cN when being stretched by 20% in the longitudinal direction of the right sleeve 4. The stretching force preferably ranges from 60 cN to 500 cN, more preferably, from 80 cN to 400 cN when the right sleeve 4 is longitudinally stretched by 20%.

As described above, the rear surface 68 of the upper end of the left sleeve 3 and the rear surface 78 of the upper end of the right sleeve 4 both function as high-tension regions, which can exert a stretching force of 45 cN or more when being longitudinally stretched by 20%. Accordingly, the rear region 8 of the body 2 of the upper body 51 of the garment, like one according to the first embodiment, exerts a tensile force pulling the rear surface 68 of the upper end of the left sleeve 3 rightward and pulling the rear surface 78 of the upper end of the right sleeve 4 leftward. Since the tensile force is not greatly reduced by the stretched rear surface 68 of the upper end of the left sleeve 3 and the stretched rear surface 78 of the upper end of the right sleeve 4, the tensile force causes a force to more forcibly move both the upper portions of the upper arms and the shoulders of a wearer backward and toward the center of the back of the wearer. This force can result in a heavy load on the upper portions of the upper arms and the shoulders of the wearer to move them backward. The load prevents the wearer from moving the shoulders forward to put the upper portions of the upper arms in front of the trunk. Thus, the upper body 51 of the garment can effectively prevent the wearer from suffering rounded shoulders and curved back. The upper body 51 of the garment can also achieve good corrective effects for persons who have already suffered rounded shoulders and curved back.

In the upper body 51 of the garment, at least the rear surface 68 and the front surface 67 of the upper end of the left sleeve 3 can exert a stretching force ranging from 45 cN to 600 cN when being stretched by 20% in a longitudinal direction of the left sleeve 3, except for a portion of the upper end of the left sleeve 3 facing the left armpit of a wearer. The stretching force preferably ranges from 60 cN to 500 cN, more preferably, from 80 cN to 400 cN when the left sleeve 3 is longitudinally stretched by 20%.

In the upper body 51 of the garment, at least the rear surface 78 and the front surface 77 of the upper end of the right sleeve 4 can exert a stretching force ranging from 45 cN to 600 cN when being stretched by 20% in a longitudinal direction of the right sleeve 4, except for a portion of the upper end of the right sleeve 4 facing the right armpit of a wearer. The stretching force preferably ranges from 60 cN to 500 cN, more preferably, from 80 cN to 400 cN when the right sleeve 4 is longitudinally stretched by 20%.

This structure can more forcibly move the upper portions of the upper arms and the shoulders of a wearer of the upper body 51 of the garment backward and toward the center of the back of the wearer. Thus, the upper body 51 of the garment can correct the posture of the wearer more effectively.

FIGS. 8-13 show structures that can move the upper portions of the upper arms and the shoulders of a wearer backward and, more effectively, toward the center of the back of the wearer. The structures can be applied to the above-described embodiments. The following will explain the structures.

Figure 8:
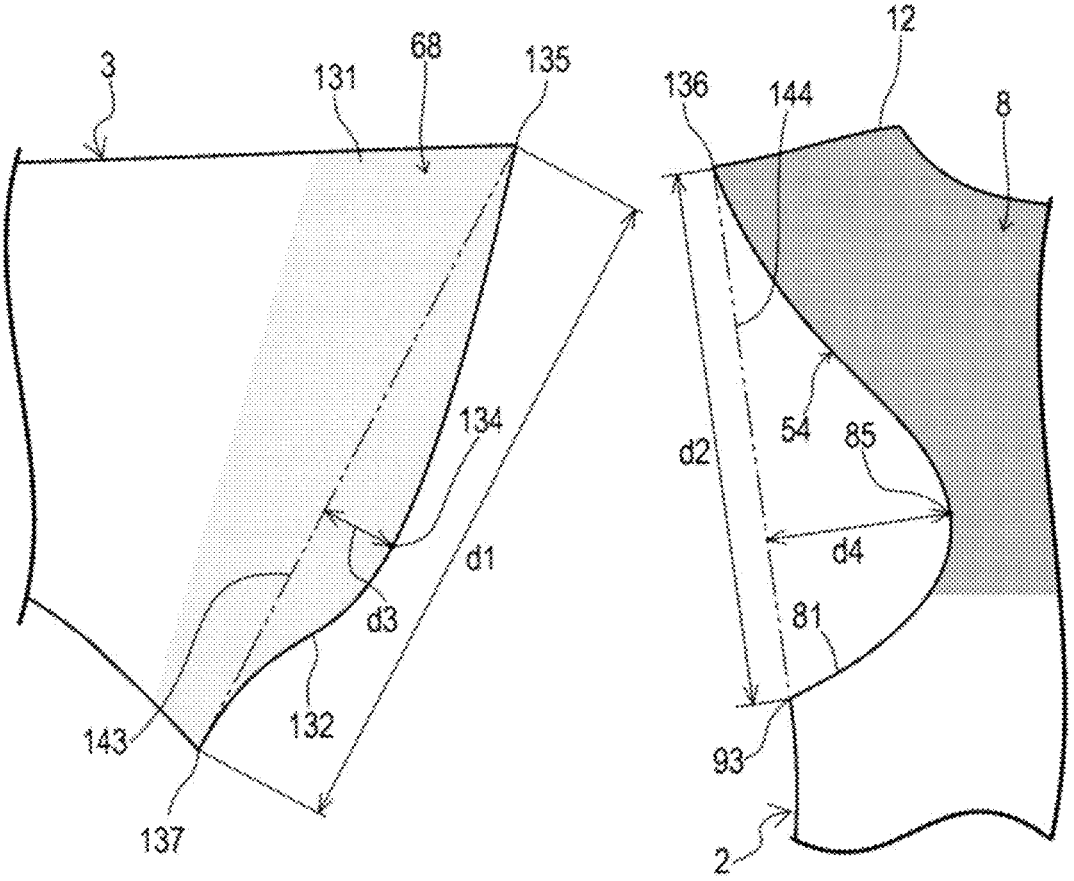
FIG. 8 is a schematic view showing a first example of the upper body of the garment of FIG. 5 with the left sleeve separated from the left side of the rear region of the body.

FIG. 8 shows a schematic view of the left side of the rear region 8 (of the rear body 12) of the body 2 and the left sleeve 3 separated from each other. From FIG. 8, highly flexible fabrics 191 described below are omitted for explanatory convenience. After being in the condition shown in FIG. 8, the left sleeve 3 abuts the left side of the rear region 8 and is sewn to it. As shown in FIG. 8, a left armhole 81 is provided at the left side of the rear region 8 of the rear body 12. To the left armhole 81, the rear surface 68 of the upper end of the left sleeve 3 is sewn. The left armhole 81 functions as the left-edge rear surface 54. The left armhole 81 is formed by cutting the upper portion of the left edge of the rear body 12 deeply. The left armhole 81 generally extends in a vertical direction of the rear body 12 and has a concave shape curving rightward, i.e. toward a vertical line 83 at the horizontal center of the rear body 12. At the nearest portion to the vertical line 83, the left armhole 81 has the deepest portion 85. The deepest portion 85 is placed on the edge of the left armhole 81, which forms a sewn curve in a concave shape.

Figure 9:
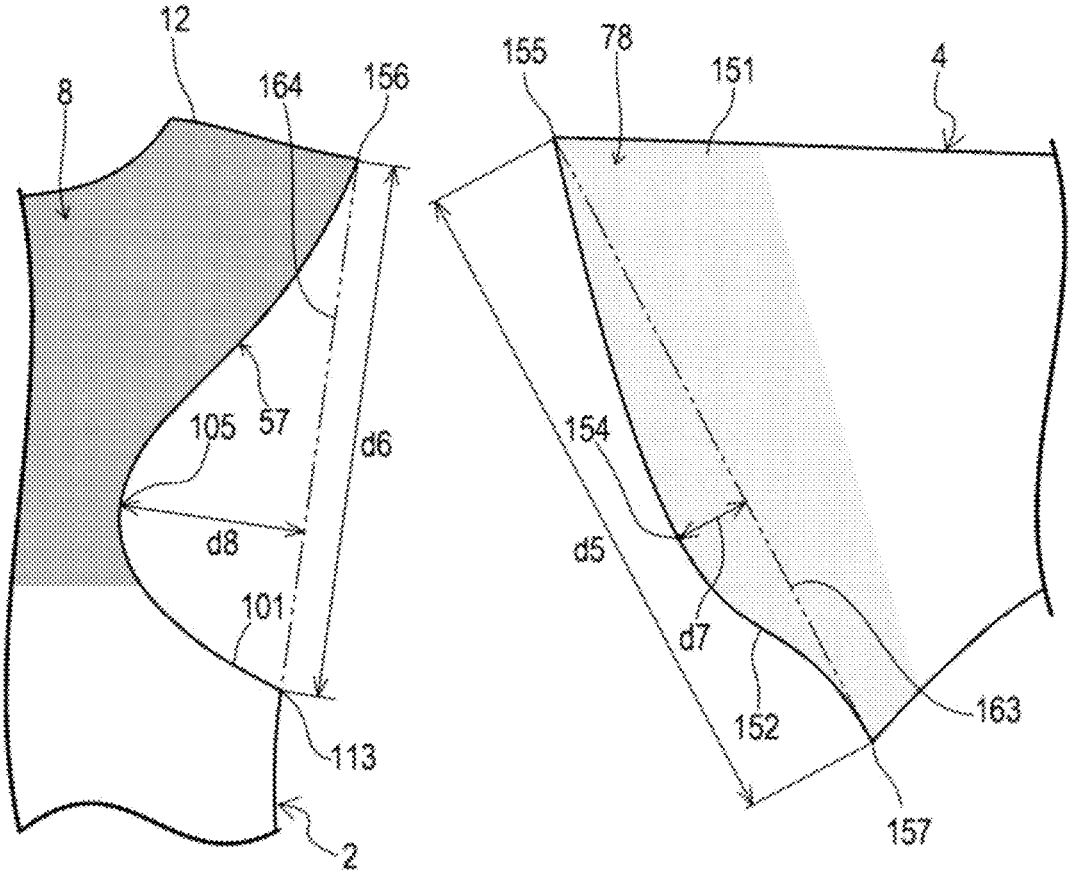
FIG. 9 is a schematic view showing an example of the upper body of the garment of FIG. 5 with the right sleeve separated from the right side of the rear region of the body.

FIG. 9 shows a schematic view of the right side of the rear region 8 (of the rear body 12) of the body 2 and the right sleeve 4 separated from each other. From FIG. 9, highly flexible fabrics 192 described below are omitted for explanatory convenience. After being in the condition shown in FIG. 9, the right sleeve 4 abuts the right side of the rear region 8 and is sewn to it.

As shown in FIG. 9, a right armhole 101 is provided at the right side of the rear region 8 of the rear body 12. To the right armhole 101, the rear surface 78 of the upper end of the right sleeve 4 is sewn. The right armhole 101 functions as the right rear surface 57. The right armhole 101 is formed by cutting the upper portion of the right edge of the rear body 12 deeply. The right armhole 101 generally extends in a vertical direction of the rear body 12 and has a concave shape curving leftward, i.e. toward the vertical line 83 at the horizontal center of the rear body 12. At the nearest portion to the vertical line 83, the right armhole 101 has the deepest portion 105. The deepest portion 105 is placed on the edge of the right armhole 101, which forms a sewn curve in a concave shape.

Since the left armhole 81 and the right armhole 101 lie at either side of the rear region 8 of the body 2, the rear region 8 reduces its horizontal width. A wearer of the upper body 1 of the garment stretches the rear region 8 at least horizontally, and thus, strengthens a tensile force of the rear region 8. The tensile force can move the upper portions of the upper arms and the shoulders of the wearer backward and toward the center of the back of the wearer.

As shown in FIG. 8, the second embodiment has the left sleeve 3 with a left sewn portion 132 that is placed at the rear surface 68 of the upper end of the left sleeve 3 and is sewn to the left armhole 81 of the rear region 8. Before the rear surface 68 of the upper end of the left sleeve 3 is sewn to the left armhole 81 of the rear region 8, the entirety of the left sewn portion 132 is horizontally shorter than the left armhole 81, and thus, the left sewn portion 132 does not reach the deepest portion 85 of the left armhole 81. More specifically, the rear surface 68 of the upper end of the left sleeve 3 has a left base 131 as well as the left sewn portion 132. The left base 131 is disposed on a side of the rear surface 68 of the upper end of the left sleeve 3 nearer to one longitudinal end (a lower end) of the left sleeve 3. The left sewn portion 132 is disposed on an opposite side of the rear surface 68 of the upper end of the left sleeve 3 nearer to another longitudinal end (an upper end) of the left sleeve 3.

The left sewn portion 132 has a shape bulging from the left base 131 toward the left armhole 81 of the rear region 8. The shape has a peak 134 at the nearest portion to the vertical line 83. The peak 134 is placed on the right edge of the left sewn portion 132 when being viewed from the back. The right edge forms a sewn curve convex to the left armhole 81.

In the rear surface 68 of the upper end of the left sleeve 3, the right edge of the left sewn portion 132 is sewn to the left armhole 81. The upper end 135 of the right edge of the left sewn portion 132 meets the upper end 136 of the left armhole 81, and the lower end 137 of the right edge of the left sewn portion 132 meets the lower end 93 of the left armhole 81. In addition, the peak 134 of the left sewn portion 132 meets the deepest portion 85 of the left armhole 81.

When the left sewn portion 132 is separated from the left armhole 81, the shortest distance d1 between the upper end 135 and the lower end 137 of the left sewn portion 132 is longer than the shortest distance d2 between the upper end 136 and the lower end 93 of the left armhole 81. In addition, the perimeter of the right edge of the left sewn portion 132 is substantially the same as the perimeter of the left armhole 81. Note that the perimeters may be designed to allow fabrics to be sewn in a stretched condition, and accordingly, the perimeters may differ from each other.

When the left sewn portion 132 is separated from the left armhole 81, the bulge of the left sewn portion 132 is smaller than the concave shape of the left armhole 81. More concretely, the shortest distance d3 between a fifth virtual line 143 and the peak 134 of the left sewn portion 132 is shorter than the shortest distance d4 between a sixth virtual line 144 and the deepest portion 85 of the left armhole 81. The fifth virtual line 143 is a straight line connecting the upper end 135 of the left sewn portion 132 with the lower end 137 thereof by the shortest distance d1. The sixth virtual line 144 is a straight line connecting the upper end 136 of the left armhole 81 with the lower end 93 thereof by the shortest distance d2. When the left sewn portion 132 and the left armhole 81 are horizontally aligned (see FIG. 8) and the upper end 135 of the left sewn portion 132 meets the upper end 136 of the left armhole 81, and the lower end 137 of the left sewn portion 132 meets the lower end 93 of the left armhole 81, the peak 134 on the sewn curve of the left sewn portion 132 does not reach (and meet) the deepest portion 85 on the sewn curve of the left armhole 81. The left sewn portion 132 has such a dimension.

As shown in FIG. 9, the second embodiment has the right sleeve 4 with a right sewn portion 152 that is placed at the rear surface 78 of the upper end of the right sleeve 4 and is sewn to the right armhole 101 of the rear region 8. Before the rear surface 78 of the upper end of the right sleeve 4 is sewn to the right armhole 101, the entirety of the right sewn portion 152 is horizontally shorter than the right armhole 101, and thus, the right sewn portion 152 does not reach the deepest portion 105 of the right armhole 101. More specifically, the rear surface 78 of the upper end of the right sleeve 4 has a right base 151 as well as the right armhole 152. The right base 151 is disposed on a side of the rear surface 78 of the upper end of the right sleeve 4 nearer to one longitudinal end (a lower end) of the right sleeve 4. The right sewn portion 152 is disposed on an opposite side of the rear surface 78 of the upper end of the right sleeve 4 nearer to another longitudinal end (an upper end) of the right sleeve 4.

The right sewn portion 152 has a shape bulging from the right base 151 toward the right armhole 101 of the rear region 8. The shape has a peak 154 at the nearest portion to the vertical line 83. The peak 154 is placed on the left edge of the right sewn portion 152 when being viewed from the back. The left edge forms a sewn curve convex to the right armhole 101.

In the rear surface 78 of the upper end of the right sleeve 4, the left edge of the right sewn portion 152 is sewn to the right armhole 101. The upper end 155 of the left edge of the right sewn portion 152 meets the upper end 156 of the right armhole 101, and the lower end 157 of the left edge of the right sewn portion 152 meets the lower end 113 of the right armhole 101. In addition, the peak 154 of the right sewn portion 152 meets the deepest portion 105 of the right armhole 101.

When the right sewn portion 152 is separated from the right armhole 101, the shortest distance d5 between the upper end 155 and the lower end 157 of the right sewn portion 152 is longer than the shortest distance d6 between the upper end 156 and the lower end 113 of the right armhole 101. In addition, the perimeter of the left edge of the right sewn portion 152 is substantially the same as the perimeter of the right armhole 101. Note that the perimeters may be designed to allow fabrics to be sewn in a stretched condition, and accordingly, the perimeters may differ from each other.

When the right sewn portion 152 is separated from the right armhole 101, the bulge of the right sewn portion 152 is smaller than the concave shape of the right armhole 101. More concretely, the shortest distance d7 between a seventh virtual line 163 and the peak 154 of the right sewn portion 152 is shorter than the shortest distance d8 between an eighth virtual line 164 and the deepest portion 105 of the right armhole 101. The seventh virtual line 163 is a straight line connecting the upper end 155 of the right sewn portion 152 with the lower end 157 thereof by the shortest distance d5. The eighth virtual line 164 is a straight line connecting the upper end 156 of the right armhole 101 with the lower end 113 thereof by the shortest distance d6. When the right sewn portion 152 and the right armhole 101 are horizontally aligned (see FIG. 9) and the upper end 155 of the right sewn portion 152 meets the upper end 156 of the right armhole 101, and the lower end 157 of the right sewn portion 152 meets the lower end 113 of the right armhole 101, the peak 154 on the sewn curve of the right sewn portion 152 does not reach (and meet) the deepest portion 105 on the sewn curve of the right armhole 101. The right sewn portion 152 has such a dimension.

Figure 10:
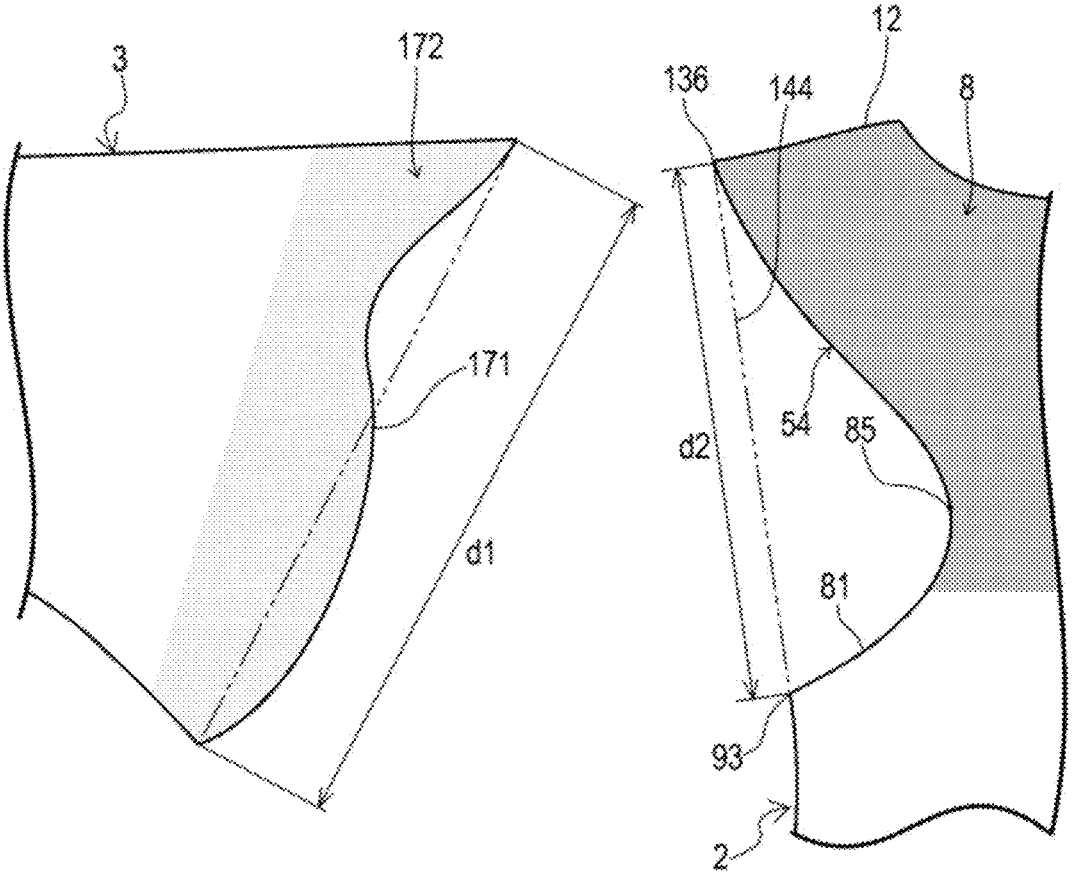
FIG. 10 is a schematic view showing a second example of the upper body of the garment of FIG. 5 with the left sleeve separated from the left side of the rear region of the body.
Figure 11:
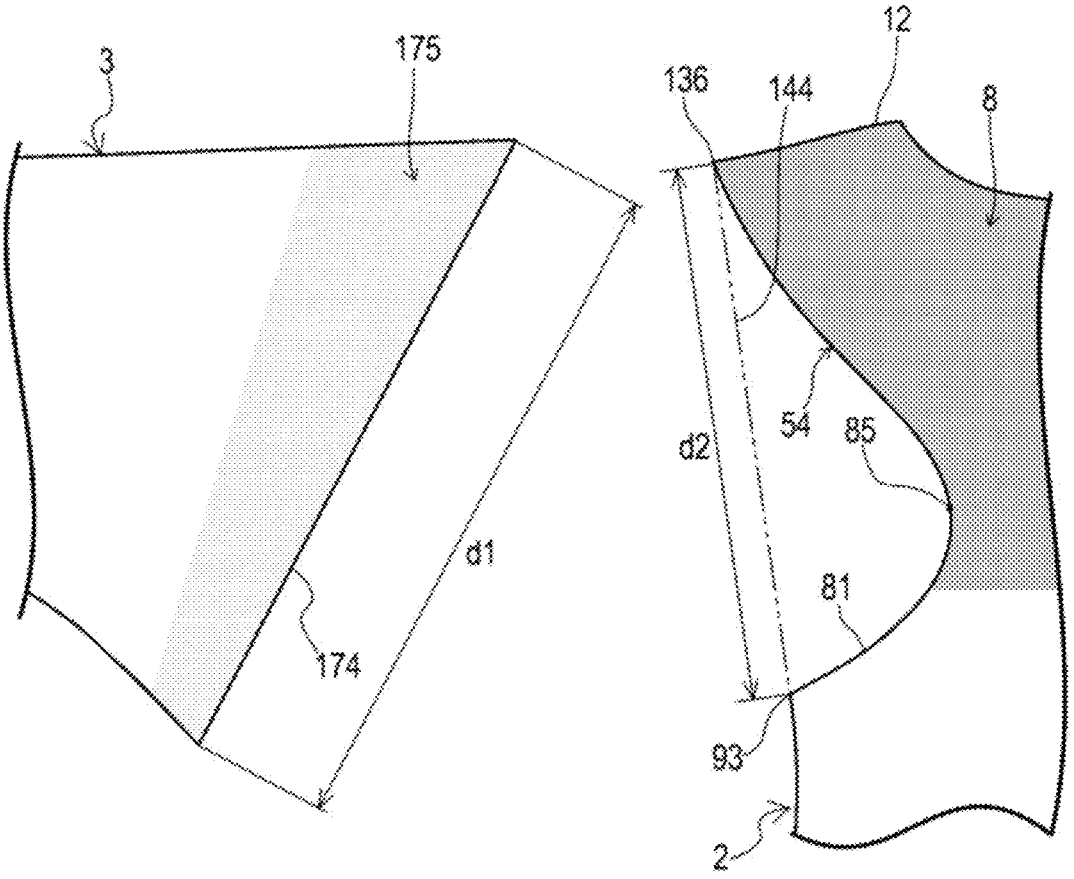
FIG. 11 is a schematic view showing a third example of the upper body of the garment of FIG. 5 with the left sleeve separated from the left side of the rear region of the body.
Figure 12:
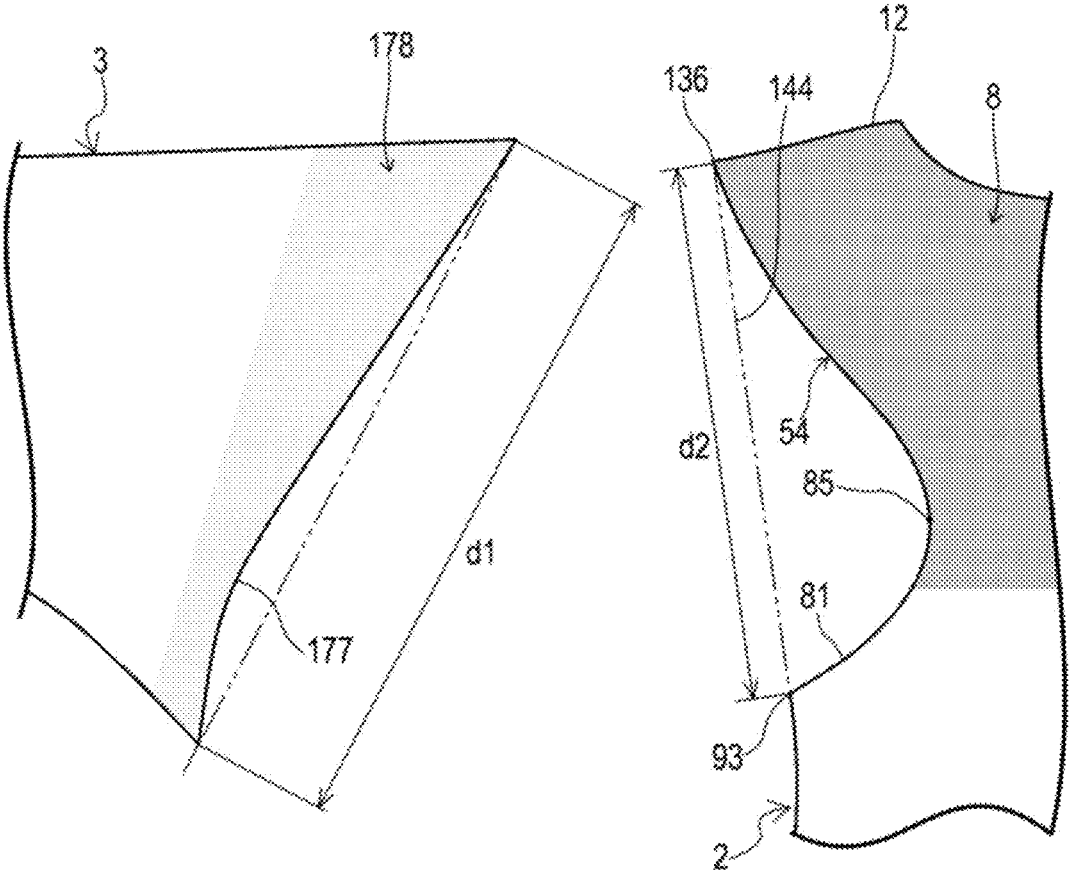
FIG. 12 is a schematic view showing a fourth example of the upper body of the garment of FIG. 5 with the left sleeve separated from the left side of the rear region of the body.

The rear surface 68 of the upper end of the left sleeve 3 is not limited to a surface with the left sewn portion 132, which is the sewn curve convex to the left armhole 81. That is, the rear surface of the upper end of the left sleeve according to the invention, which is not limited to the rear surface 68, only has to have a dimension such that it does not reach the deepest portion of the left armhole when it is separated from the left armhole. For example, as shown in FIG. 10, the rear surface 172 of the upper end may have a left sewn portion 171, which is a concavo-convex sewn curve with respect to the left armhole 81. As shown in FIG. 11, the rear surface 175 of the upper end may have a left sewn portion 174, which is a straight sewn line. As shown in FIG. 12, the rear surface 178 of the upper end may have a left sewn portion 177, which is a sewn curve concave to the left armhole 81.

The rear surface of the upper end of the right sleeve according to the invention can have a shape similar to the rear surface of the upper end of the left sleeve according to the invention. The rear surface 78 of the upper end of the right sleeve and the rear surface 68 of the upper end of the left sleeve 3 are horizontally symmetric with respect to the rear region 8.

As shown in FIGS. 7 and 8, the deepest portion 85 of the left armhole 81 is preferably placed below the vertical center 181 of the left armhole 81. As shown in FIGS. 7 and 9, the deepest portion 105 of the right armhole 101 is preferably placed below the vertical center 182 of the right armhole 101. These structures prevent a portion of the upper body 1 facing a shoulder of a wearer from shifting to the center of the back of the wearer, and thus, these structures enable the upper body 1 to avoid wrinkles and obstructing movement of the wearer.

As shown in FIG. 7, the depth v1 of the deepest portion 85 of the left armhole 81 equals the depth v2 of the deepest portion 105 of the right armhole 101. Together the depths v1 and v2, the horizontal length v3 of the rear region 8 between the deepest portion 85 of the left armhole 81 and the deepest portion 105 of the right armhole 101 preferably meets the ratio v1:v2:v3=1:1:0.5-6. The depth v1 of the deepest portion 85 of the left armhole 81 corresponds to the shortest distance between the deepest portion 85 and a third virtual line 87. As shown in FIG. 7, the third virtual line 87 is a substantially vertical straight line extending from the left side 13 of the upper body 51 of the garment (i.e. the lower end 93 of the left armhole 81) toward the left shoulder 95 thereof and above the rear body 12. The third virtual line 87 is substantially parallel to the vertical line 83 at the horizontal center of the rear body 12. The depth v2 of the deepest portion 105 of the right armhole 101 corresponds to the shortest distance between the deepest portion 105 and a fourth virtual line 107. As shown in FIG. 7, the fourth virtual line 107 is a substantially vertical straight line extending from the right side 14 of the upper body 51 of the garment (i.e. the lower end 113 of the right armhole 101) toward the right shoulder 115 thereof and above the rear body 12. The fourth virtual line 107 is substantially parallel to the vertical line 83 at the horizontal center of the rear body 12. The horizontal length v3 of the rear region 8 between the deepest portion 85 of the left armhole 81 and the deepest portion 105 of the right armhole 101 corresponds to the shortest distance between the deepest portions 85 and 105.

Figure 13:
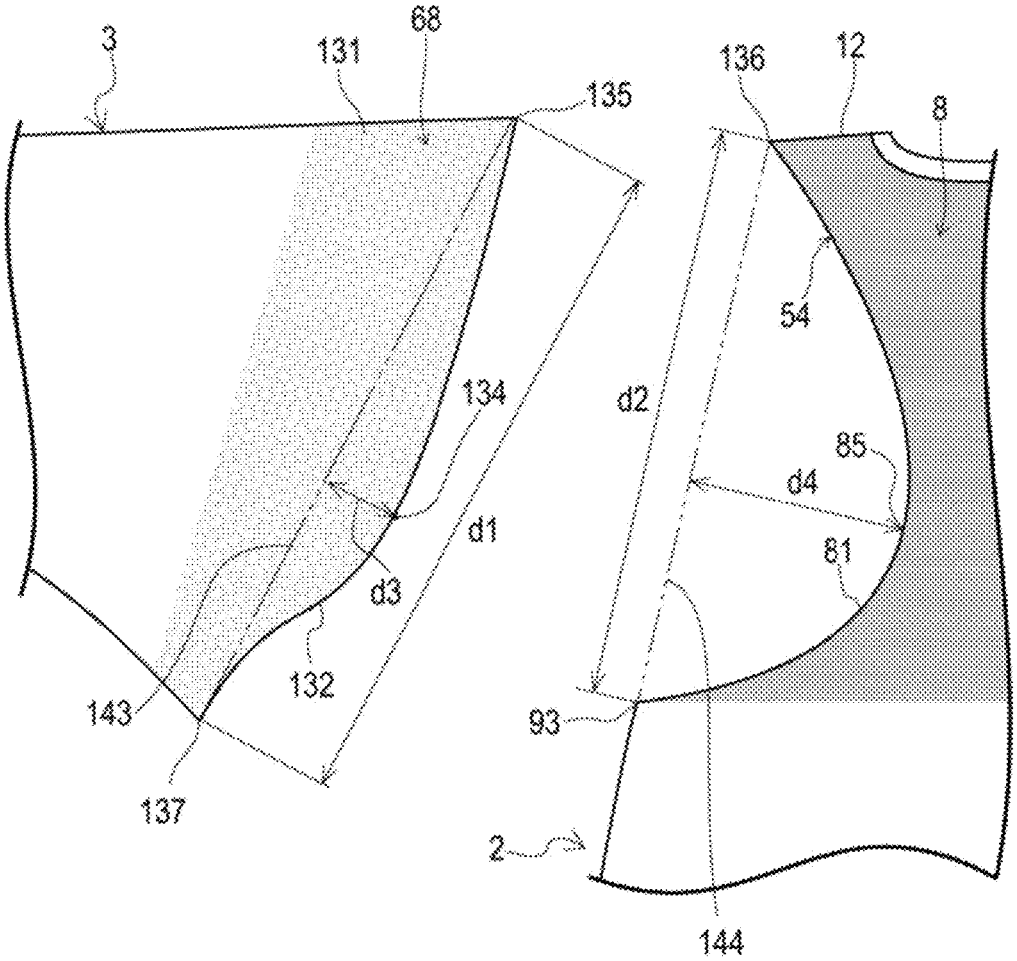
FIG. 13 is a schematic view showing a fifth example of the upper body of the garment of FIG. 5 with the left sleeve separated from the left side of the rear region of the body.

Although FIG. 8 shows the lower end 93 of the left armhole 81 located at the right of a point directly below the upper end 136 of the left armhole 81, this is not a limited configuration. As shown in FIG. 13, the lower end 93 of the left armhole 81 may be located at the left of a point directly below the upper end 136 of the left armhole 81. The same is true for the right armhole 101. That is, the lower end of the right armhole may be located at the right of a point directly below the upper end of the right armhole.

As shown in FIGS. 5, 6, and 7, at least a portion of the left sleeve 3 facing the left armpit of a wearer may have a highly flexible fabric 191. At least a portion of the right sleeve 4 facing the right armpit of the wearer may have a highly flexible fabric 192. The fabric 191 of the left sleeve 3 is placed below one longitudinal end (an upper end) of the left sleeve 3 to keep the above-described function of the rear surface 68 of the upper end of the left sleeve 3. The fabric 192 of the right sleeve 4 is placed below one longitudinal end (an upper end) of the right sleeve 4 to keep the above-described function of the rear surface 78 of the upper end of the right sleeve 4. These structures can prevent a wearer of the upper body 51 of the garment from feeling a pain on his/her armpits even if the tensile force of the rear region 8 moves the rear surface 68 of the upper end of the left sleeve 3 and the rear surface 78 of the upper end of the right sleeve 4 backward and toward the center of the back of the wearer.

Figure 14:
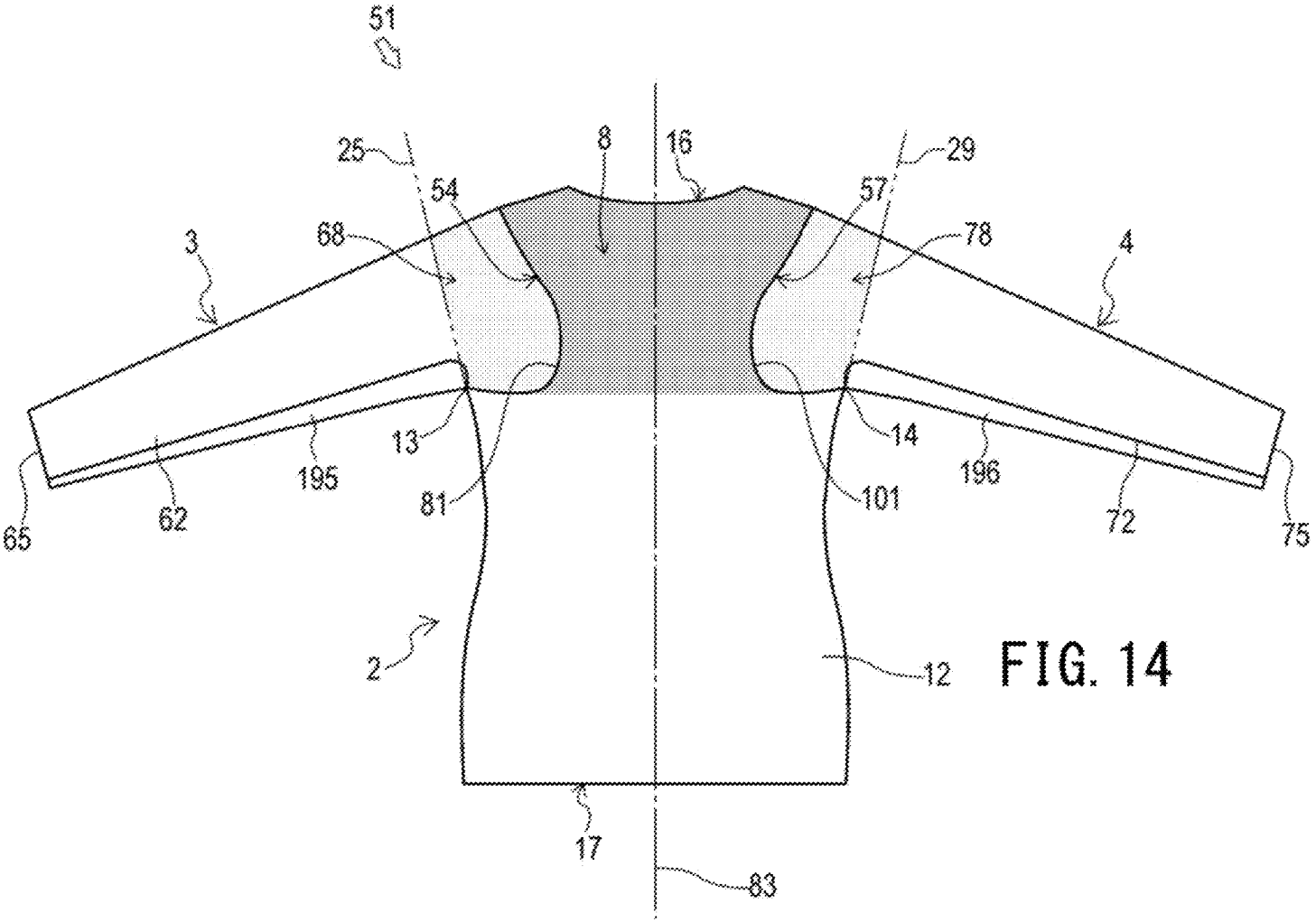
FIG. 14 is a rear elevation view of the upper body of a garment according to yet another embodiment of the invention.

In FIGS. 5, 6, and 7, the highly flexible fabrics 191 and 192 only cover portions of the left sleeve 3 and the right sleeve 4 facing the armpits of the wearer. However, the highly flexible fabrics are not limited to cover the portions. For example, as shown in FIG. 14, highly flexible fabrics 195 and 196 cover portions of the left sleeve 3 and the right sleeve 4 facing one side of the upper and lower arms, in addition to the armpits of the wearer.

In contrast to the left sleeve 3 of the first and second embodiments, a left sleeve according to the invention may have the following structure: At least a rear surface of its upper end includes a non-stretchy region that is stretched by less than 20% when receiving a longitudinal stretching force of 45 cN or more. This left sleeve may be completely non-stretchy. In contrast to the right sleeve 4 of the first and second embodiments, a right sleeve according to the invention may have the following structure: At least a rear surface of its upper end includes a non-stretchy region that is stretched by less than 20% when receiving a longitudinal stretching force of 45 cN or more. This right sleeve may be completely non-stretchy.

In contrast to the left sleeve 3 of the first and second embodiments, a left sleeve according to the invention may have the following structure: At least a rear surface of its upper end includes a high-tension region that exerts a stretching force of 45 cN or more when being longitudinally stretched by 20%, and a front surface of the upper end includes a non-stretchy region that is stretched by less than 20% when receiving a longitudinal stretching force of 45 cN or more. In contrast to the right sleeve 4 of the first and second embodiments, a right sleeve according to the invention may have the following structure: At least a rear surface of its upper end includes a high-tension region, and a front surface of the upper end includes a non-stretchy region. In this case, the front and rear surfaces of the sleeves may be separable, i.e. made of different fabrics. Alternatively, the front and rear surfaces may be integrated with each other, i.e. made of the same fabric to share a high-tension region, and then, a non-stretchy region may be made of other fabrics at least in the front surfaces of the upper ends of the sleeves.

In contrast to the left sleeve 3 of the first and second embodiments, a left sleeve according to the invention may have the following structure: At least a rear surface of its upper end includes a non-stretchy region that is stretched by less than 20% when receiving a longitudinal stretching force of 45 cN or more, and a front surface of the upper end includes a high-tension region that exerts a stretching force of 45 cN or more when being longitudinally stretched by 20%. In contrast to the right sleeve 4 of the first and second embodiments, a right sleeve according to the invention may have the following structure: At least a rear surface of its upper end includes a non-stretchy region, and a front surface of the upper end includes a high-tension region. In this case, the front and rear surfaces of the sleeves may be separable, i.e. made of different fabrics. Alternatively, the front and rear surfaces may be integrated with each other, i.e. made of the same fabric to share a high-tension region, and then, a non-stretchy region may be made of other fabrics at least in the rear surfaces of the upper ends of the sleeves.

In view of the explanation described above, the invention can obviously have many variations and modifications. Accordingly, it should be understood that the invention can have embodiments other than those in the description within the scope of the claims attached to the description.

DESCRIPTION OF REFERENCE SYMBOLS

1 upper body garment, 2 body, 3 left sleeve, 4 right sleeve, 8 rear region, 23 rear surface of upper end of left sleeve, 28 rear surface of upper end of right sleeve, 51 upper body garment, 67 front surface of upper end of left sleeve, 68 rear surface of upper end of left sleeve, 77 front surface of upper end of right sleeve, 78 rear surface of upper end of right sleeve, 81 left armhole, 85 deepest portion of left armhole, 101 right armhole, 105 deepest portion of right armhole, 132 left sewn portion, 152 right sewn portion, 181 vertical center of left armhole, 182 vertical center of right armhole, 191 highly flexible fabric, 192 highly flexible fabric, 195 highly flexible fabric, 196 highly flexible fabric, v1 depth of deepest portion of left armhole, v2 depth of deepest portion of right armhole, v3 horizontal length of rear region between deepest portions of left and right armholes.

What is claimed is:

1. An upper body garment comprising:

a body including a rear body and a front body, the rear body having a left armhole on a left side of the body and a right armhole on a right side of the body, wherein a portion of the rear body between the left armhole and the right armhole is configured to exert a tensile force to pull shoulder blades of a wearer horizontally inward;

a left sleeve including a left sewn portion that is sewn to the left armhole, wherein the left sleeve includes, before being sewn to the left armhole, a first bulge on a rear surface of the left sleeve, wherein the left armhole includes, before the left sleeve is sewn to the left armhole, a first concavity, wherein an apex of the first bulge is narrower in horizontal width than a deepest portion of the first concavity when the first bulge is in an unstretched state, wherein a horizontal width of the apex of the first bulge is measured from a first straight line connecting an upper end of the left sewn portion with a lower end of the left sewn portion, and wherein a horizontal width of the deepest portion of the first concavity is measured from a second straight line connecting an upper end of the left armhole to a lower end of the left armhole; and a right sleeve including a right sewn portion that is sewn to the right armhole, wherein the right sleeve includes, before being sewn to the right armhole, a second bulge on a rear surface of the right sleeve, wherein the right armhole includes, before the right sleeve is sewn to the right armhole, a second concavity, wherein an apex of the second bulge is narrower in horizontal width than a deepest portion of the second concavity when the second bulge is in an unstretched state, wherein a horizontal width of the apex of the second bulge is measured from a third straight line connecting an upper end of the right sewn portion with a lower end of the right sewn portion, and wherein a horizontal width of the second concavity is measured from a fourth straight line connecting an upper end of the right armhole to a lower end of the right armhole.

2. The upper body garment according to claim 1, wherein:

at least the rear surface of the left sleeve includes a high-tension region that is configured to exert a stretching force when being stretched in a longitudinal direction of the left sleeve by the tensile force; and at least the rear surface of the right sleeve includes a high-tension region that is configured to exert a stretching force when being stretched by in a longitudinal direction of the right sleeve by the tensile force.

3. The upper body garment according to claim 2, wherein:

the high-tension region of the left sleeve extends from the rear surface of the left sleeve to a front surface of the left sleeve; and the high-tension region of the right sleeve extends from the rear surface of the right sleeve to a front surface of the right sleeve.

4. The upper body garment according to claim 2, wherein:

a front surface of the left sleeve includes a non-stretchy region that is configured to stretch less than the high-tension region of the left sleeve when receiving the stretching force in the longitudinal direction of the left sleeve; and a front surface of the right sleeve includes a non-stretchy region that is configured to stretch less than the high-tension region of the right sleeve when receiving the stretching force in the longitudinal direction of the right sleeve.

5. The upper body garment according to claim 1, wherein:

a front surface of the left sleeve includes a high-tension region that is configured to exert a stretching force when being stretched in a longitudinal direction of the left sleeve by the tensile force; and a front surface of the right sleeve includes a high-tension region that is configured to exert a stretching force when being stretched in a longitudinal direction of the right sleeve by the tensile force.

6. The upper body garment according to claim 5, wherein:

at least a rear surface of the left sleeve includes a non-stretchy region that is configured to stretch less than the high-tension region of the left sleeve when receiving the stretching force in the longitudinal direction of the left sleeve; and at least a rear surface of the right sleeve includes a non-stretchy region that is configured to stretch less than the high-tension region of the right sleeve when receiving the stretching force in the longitudinal direction of the right sleeve.

7. The upper body garment according to claim 6, wherein:

the non-stretchy region of the left sleeve ranges from the rear surface of the left sleeve to the front surface of the left sleeve; and the non-stretchy region of the right sleeve ranges from the rear surface of the right sleeve to the front surface of the right sleeve.

8. The upper body garment according to claim 1, wherein:

a horizontal distance measured from the left side of the body to the deepest portion of the first concavity equals a horizontal distance measured from the right side of the body to the deepest portion of the second concavity; and wherein another horizontal distance measured from the deepest portion of the first concavity to the deepest portion of the second concavity equals one-half to six times as long as the horizontal distance.

9. The upper body garment according to claim 1, wherein at least a portion of the left sleeve configured to face a left armpit of a wearer and a portion of the right sleeve configured to face a right armpit of the wearer have flexible fabrics.

10. The upper body garment according to claim 1, wherein the front body and the rear body are made of a same fabric.

11. The upper body garment according to claim 1, wherein the front body and the rear body are made of a same fabric, wherein the same fabric has woofs directed vertically in the front body and horizontally in the rear body.

12. The upper body garment according to claim 1, wherein the rear body includes a portion made of a same fabric as the front body, wherein resin is applied to the portion such that the portion is configured to exert a horizontal tensile force greater than the front body.

13. The upper body garment according to claim 1, wherein the rear body is made of a fabric that is configured to exert a tensile force greater than a tensile force able to be exerted by the front body.

14. The upper body garment according to claim 1, wherein the rear body is made of laminated fabrics that are configured to exert a tensile force greater than a tensile force able to be exerted by the front body.

* * * * *